United States Patent [19]

Taguchi

[11] 4,419,083

[45] Dec. 6, 1983

[54] TILT LEVER RETURNING MECHANISM FOR OUTBOARD ENGINE

[75] Inventor: Michihiro Taguchi, Hamamatsu, Japan

[73] Assignees: Yamaha Hatsudoki Kabushiki Kaisha, Iwata; Sanshin Kogyo Kabushiki Kaisha, Hamamatsu, both of Japan

[21] Appl. No.: 343,467

[22] Filed: Jan. 28, 1982

[30] Foreign Application Priority Data

Jan. 31, 1981 [JP] Japan ..... 56-13480

[51] Int. Cl.[3] ..... B63H 21/26; B63H 5/12

[52] U.S. Cl. ..... 440/56; 440/55; 440/61; 188/282

[58] Field of Search ..... 440/53, 55, 56, 61, 440/64, 65, 900

[56] References Cited

U.S. PATENT DOCUMENTS 2,893,342 7/1959 Langford ..... 440/61

FOREIGN PATENT DOCUMENTS 55-83697 6/1980 Japan ..... 440/900

55-148690 11/1980 Japan ..... 440/53

*Primary Examiner*—Trygve M. Blix

*Assistant Examiner*—Rodney A. Corl

*Attorney, Agent, or Firm*—Ernest A. Beutler

[57] ABSTRACT

A tilting supporting arrangement for an outboard drive unit that permits it to be pivoted from a normal running position to a tilted up position. A tilt stop mechanism is provided for holding the unit in its tilted up position and a tilt locking mechanism is provided for holding the unit in its tilted down position. Each of the tilt stop and tilt locking mechanisms is movable between and operative position for retaining the drive unit in the respective position and released positions. The tilt locking mechanism and tilt stop mechanism are oriented in such a way that when the tilt stop mechanism is moved to its operative position and the drive unit is tilted up, the tilt locking mechanism will automatically be operated to its operative position.

7 Claims, 9 Drawing Figures

TILT LEVER RETURNING MECHANISM FOR OUTBOARD ENGINE

BACKGROUND OF THE INVENTION

This invention relates to a tilt lever returning mechanism for an outboard engine and more particularly to an improved and simplified arrangement for the tilting operation of an outboard drive unit.

As is well known, outboard motor are normally mounted on the transom of a boat for pivotal movement about a horizontally extending axis so that the motor may be tilted up from an operative to a position wherein the lower unit will be clear of the water. Normally, a tilt locking mechanism is employed for locking the motor in its normal operative position and a tilt stop mechanism is provided for holding the motor in its upper position. Thus, in order to tilt the motor up from its operative position, it is necessary, with prior art devices, to release the tilt locking mechanism, raise the motor, and place the tilt stop mechanism in its operative position to retain the motor in its upper position. In order to lower the motor, it is necessary to release the tilt stopping mechanism, swing the motor downwardly and re-engage the tilt locking mechanism. If the tilt locking mechanism is accidently left unlocked, there is a danger that the motor may jump up during navigation.

In order to simplify the operation of the tilt locking mechanism and tilt stop mechanism, it has been proposed by the applicants to apply an interconnecting linkage arrangement whereby operation of the tilt locking mechanism and tilt stopping mechanism are interrelated. Such an arrangement is shown in our Japanese patent application No. 53-154147. Although the arrangement shown in that patent application simplifies the operation required to tilt the motor up and down, it requires a substantial number of parts such as links, levers, hooks, springs or the like. The addition of these various components adds to the cost of the assembly.

It is, therefore, a principal object of this invention to provide a simplified mechanism for interrelating the tilt locking and tilt stop mechanisms of an outboard drive assembly.

It is another object of this invention to provide an arrangement wherein movement of the tilt stop mechanism to its operative position automatically effects movement of the tilt locking mechanism to its locking position.

SUMMARY OF THE INVENTION

This invention is adapted to be embodied in an outboard drive unit having a first member adapted to be fixed to the hull of the boat, a drive unit supported for pivotal tilting movement by the first member about a generally horizontally extending axis, tilt stop means movable between a released position and an operative position for retaining the driving unit in a tilted up position, and tilt locking means movable between a released position and a locked position for releasably restraining the drive unit in a tilted down position. In accordance with the invention, means on the tilt stop means are engageable with means on the tilt locking means for moving the tilt locking means from its released position to its locked position upon movement of the tilt stop means to its operative position when the drive unit is in its tilted up position.

DETAILED DESCRIPTION OF THE PREFERRED EMBODIMENT

This invention is adapted to be embodied in the mounting arrangement for an outboard drive unit such as an outboard motor. Inasmuch as the invention relates to the mounting arrangement, only this portion of the engine has been illustrated and will be described.

Figure 9:
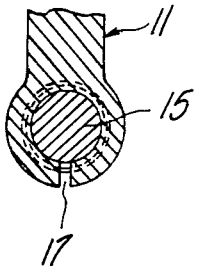
FIG. 9 is a cross-sectional view taken along the line 9—9 of FIG. 2.

The motor includes a clamp bracket assembly, indicated generally by the reference numeral 11, that is adapted to affix the motor to a transon 12 of the hull of a boat. The clamp bracket assembly 11 includes a pair of generally U-shaped plates 13 and 14 which extend across and engage the upper portion of the transom 12. Clamp bolts 15 pass through the forwardmost portion of the legs of the plates 13 and 14 and bring a pad 16 into engagement with the forward portion of the transom 12 so as to affix the clamp bracket assembly 11 to the transom 12. As seen in the cross-sectional view of FIG. 9, the lower portions of the legs of the plates 13 and 14 which pass the clamping bolts are formed with downwardly opening slots 17 so that any water which may accumulate in the threaded area can be discharged and will not be retained around the threads where corrosion might otherwise occur. The clamp bracket assembly 11 also may be affixed to the transom 12 by means of bolts 18 that pass through the transon 12 and are affixed in any known manner to the clamp bracket assembly 11.

The side plates 13 and 14 are joined by means of a generally horizontally extending pivot pin 19 that extends through bushings formed in the side plates 13 and 14 and which is held in axial position by means of nuts 21. A swivel bracket assembly, indicated generally by the reference numeral 22, is pivotally supported on the pivot pin 19 between the side plates 13 and 14. The swivel bracket assembly 22 has a generally vertically extending bearing portion 23 that journals the steering shaft of the associated engine. The engine comprising a power head drive shaft housing and lower unit of which are not illustrated since it per se forms no part of the invention, is affixed to the steering shaft in any known manner, as by means of an upper bracket 24 and a lower bracket 25. A tiller 26 is affixed to the upper bracket 24 for steering of the motor about the steering axis defined by the bearing portion 23.

The lower ends of the side plates 13 and 14 on the rearward side of the transon 12 are connected to a connecting member 27 by bolts 28. Adjacent the rearward end of the connecting member 27, the side plates 13 and 14 are provided with a plurality of apertures 29 that are adapted to selectively receive a tilt lock rod 30 which is, in turn, engaged by an integral arm portion 31 of the swivel bracket assembly 22 so as to adjust the trim angle of the motor relative to the transom 12.

A hydraulic actuator, indicated generally by the reference numeral 32 is interposed between the connecting member 27 and the swivel bracket 22 so as to permit the motor to swing up if submerged obstacles are encountered when the boat in travelling in a forward direction and to permit the gradual return of the motor to its trim position when the obstacles is removed or when the engine is being tilted down from its up position to its normal operating position.

The actuator assembly 32 includes a cylinder housing 33 having a boss 34 at its upper end that is pivotally connected to the swivel assembly 23 by means of a pivot pin 35. The actuator 32 also has a piston rod 36 that is axially movable relative to the cylinder housing 33 and which is pivotally connected to the connecting member 27 by means of a pivot pin 37.

The internal construction of the actuator 32 may be best understood by reference to FIGS. 4 through 7. The cylinder housing 33 is formed with an internal bore 38 in which a piston assembly, indicated generally by the reference numeral 39, is supported for reciprocation. The piston assembly 39 is affixed, as by means of a threaded connection, to the piston rod 36. The piston 39 divides the cylinder bore 38 into a lower chamber 41 and an upper chamber 42. A compressed gas such as nitrogen is contained within a volume 43 above the hydraulic fluid which fills the bore 38 and partially fills the chamber 42. The liquid level is shown by the broken line 44 in FIG. 4. The compressed gas expands and contracts to compensate for the changes in fluid volume that occurs due to the area displayed by the piston rod 36 in the chamber 41 at its various axial positions as is well known in this art.

Carried by the piston assembly 39 is a first series of three relatively large check valves 45 that are disposed so as to permit flow from the chamber 41 into the chamber 42 upon upward movement of the cylinder housing 33 relative to the piston assembly 39. In addition, a smaller single check valve 46 is positioned in the piston assembly 39 and permits flow from the chamber 42 into the chamber 41 at a slower rate when the cylinder housing 33 is moving downwardly relative to the piston assembly 39.

In addition to the check valves 45 and 46 carried by the piston assembly 39, there is a releasable check valve assembly, indicated generally by the reference numeral 47, provided in a bypass passage that extends from the lowermost portion of the lower chamber 41 to a position in the upper chamber 42 that is at the lower periphery of this chamber when the piston assembly 39 is at the maximum uppermost position. This bypass passageway consists of a horizontally extending passage 48 that extends through the cylinder wall from the cylinder bore 38 at a point that is in communication with a relief 49 formed in the body of the piston assembly 39. The passage 48, therefore, always communicates with the oil in the chamber 42. The outer end of the passage 48 is closed by a plug 49. Between its ends, the passage 48 is intersected by a bore in which a ball-type check valve element 51 of the check valve assembly 47 is positioned. The ball 51 is maintained in a normally closed position by means of a spring 52 that is engaged with the ball 51 and a closure plug 53. To the rear of the seat with which the ball valve element 51 cooperates, there is a vertically extending passage 54 formed in the cylinder housing 33 in generally parallel relationship to the cylinder bore 38. At it lower end the passage 54 is intersected by a transversely extending passage 55 which communicates with the lower end of the chamber 41.

The operation of the check valve 47 is such that flow through the bypass passageway from the lower chamber 41 to the upper chamber 42 is precluded. However, the check valve 47 will open if sufficient pressure difference exists to permit flow from the chamber 42 to the lower chamber 41.

Figure 6:
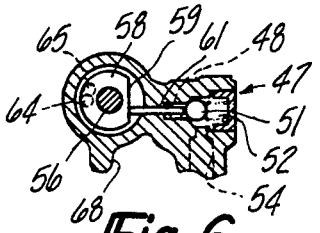
FIG. 6 is a cross-sectional view taken along the line 6—6 of FIG. 5 and shows the tilt locking mechanism in its locked position.
Figure 7:
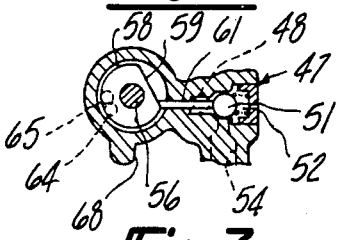
FIG. 7 is a cross-sectional view, in part similar to FIG. 6, showing the tilt locking mechanism in its released position.
Figure 8:
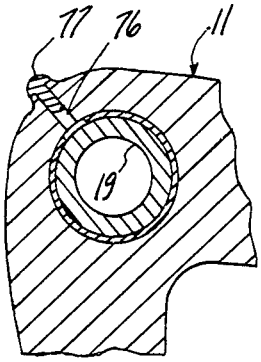
FIG. 8 is a cross-sectional view taken along the line 8—8 of FIG. 1.

The check valve assembly 47 can be manually opened and closed, in a manner to be described and, hence, operates as a tilt lock mechanism. This tilt lock mechanism includes a tilt lock operating shaft 56 that is rotatably journaled by a plug 57 that is screwed into the cylinder housing 33. The inner end of the tilt lock shaft 56 carries an integral cam 58 which, as shown in FIGS. 6 and 7, has a generally cylindrical configuration with a flat 59 formed at one side thereof. The flat 59 engages an actuating pin 61 that is slideably supported within the cylinder housing 33 and is engageable with the ball valve element 51 so as to effect its opening and closing. When the tilt lock shaft 56 is in its normal locked position (FIG. 6), there is no force exerted on the actuating pin 61 and the ball valve element 51 may be held in its seated position by the spring 52. Of course, if sufficient pressure difference is generated between the passages 48 and 54, the valve element 51 may open. When the tilt lock actuating shaft 56 is rotated in a counterclockwise direction as viewed in FIGS. 6 and 7, and as indicated by the arrow 60 in FIG. 5, the flat 59 will urge the pin 61 to the right and unseat the ball valve element 51 against the action of the spring 52.

The tilt lock operating shaft 56 and cam 58 are normally held in their locked position by means of a ball detent 62 that is urged by a spring 63 into a corresponding recess 64 formed in the rear face of the cam 58. When the tilt lock operating shaft 56 is rotated from its normal locked position, the ball detent 62 will be cammed out of the recess 64 against the action of the spring 63. There is also a recess 65 which is positioned to be engaged by the ball detent 62 when the cam 58 is in its released position so that the cam 58 and tilt lock operating shaft 56 will also be resiliently held in the released position as shown in FIG. 7.

Figure 1:
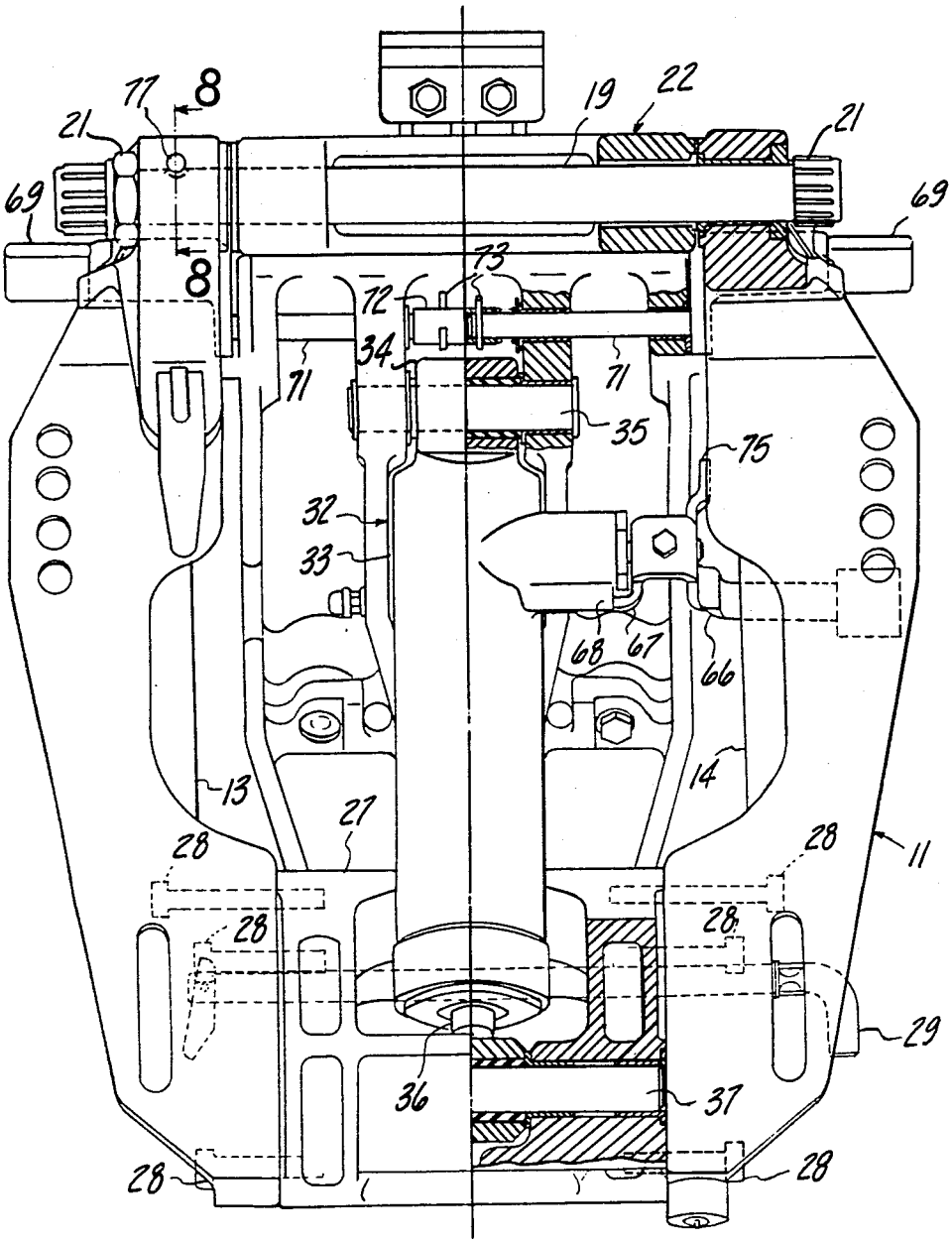
FIG. 1 is a front elevational view of an outboard motor constructed in accordance with an embodiment of this invention, with portions shown in section.
Figure 2:
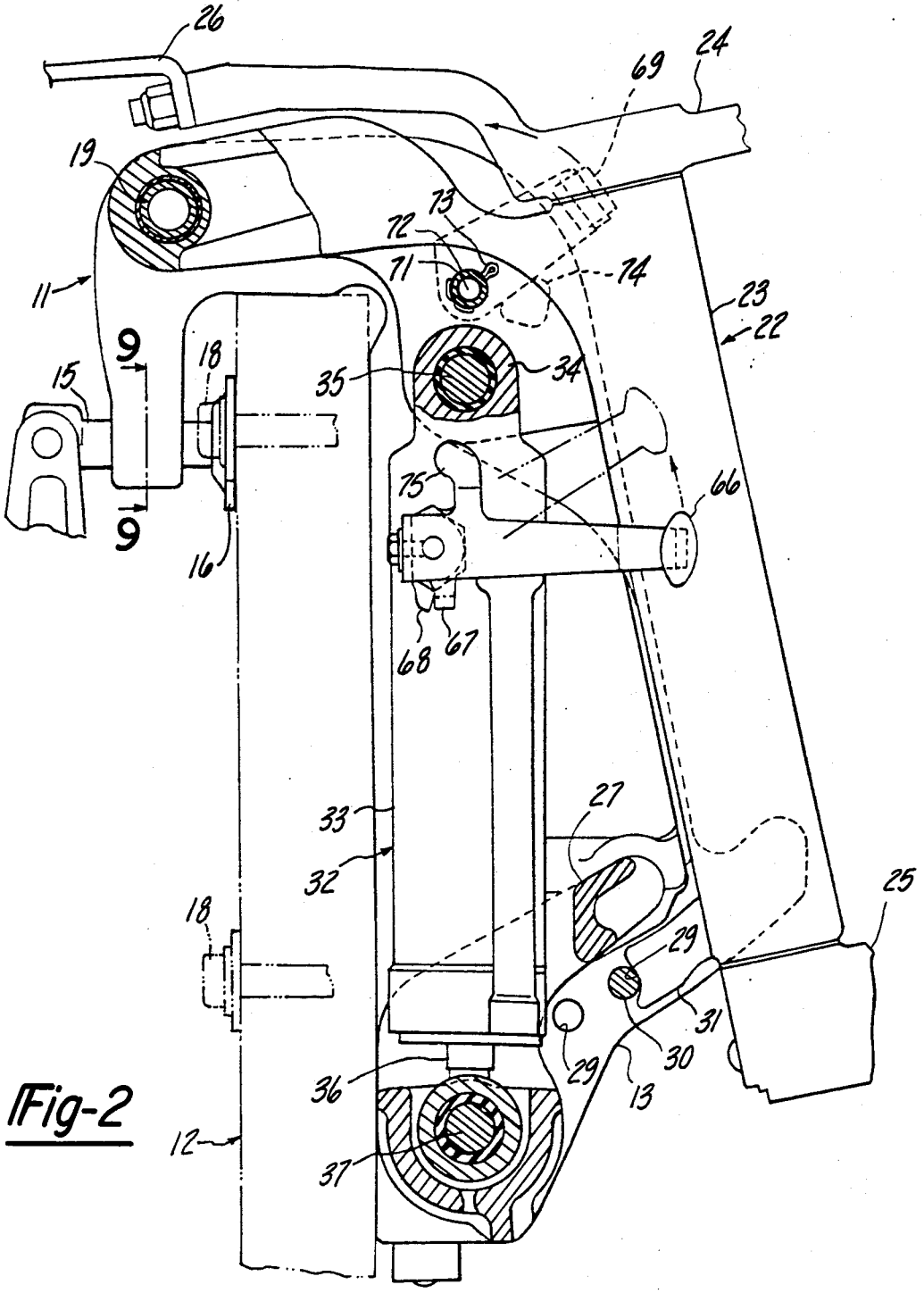
FIG. 2 is a side elevational view of a portion of the motor with portions being broken away, as mounted on a boat, and with the motor being in its tilted down, operative position.
Figure 3:
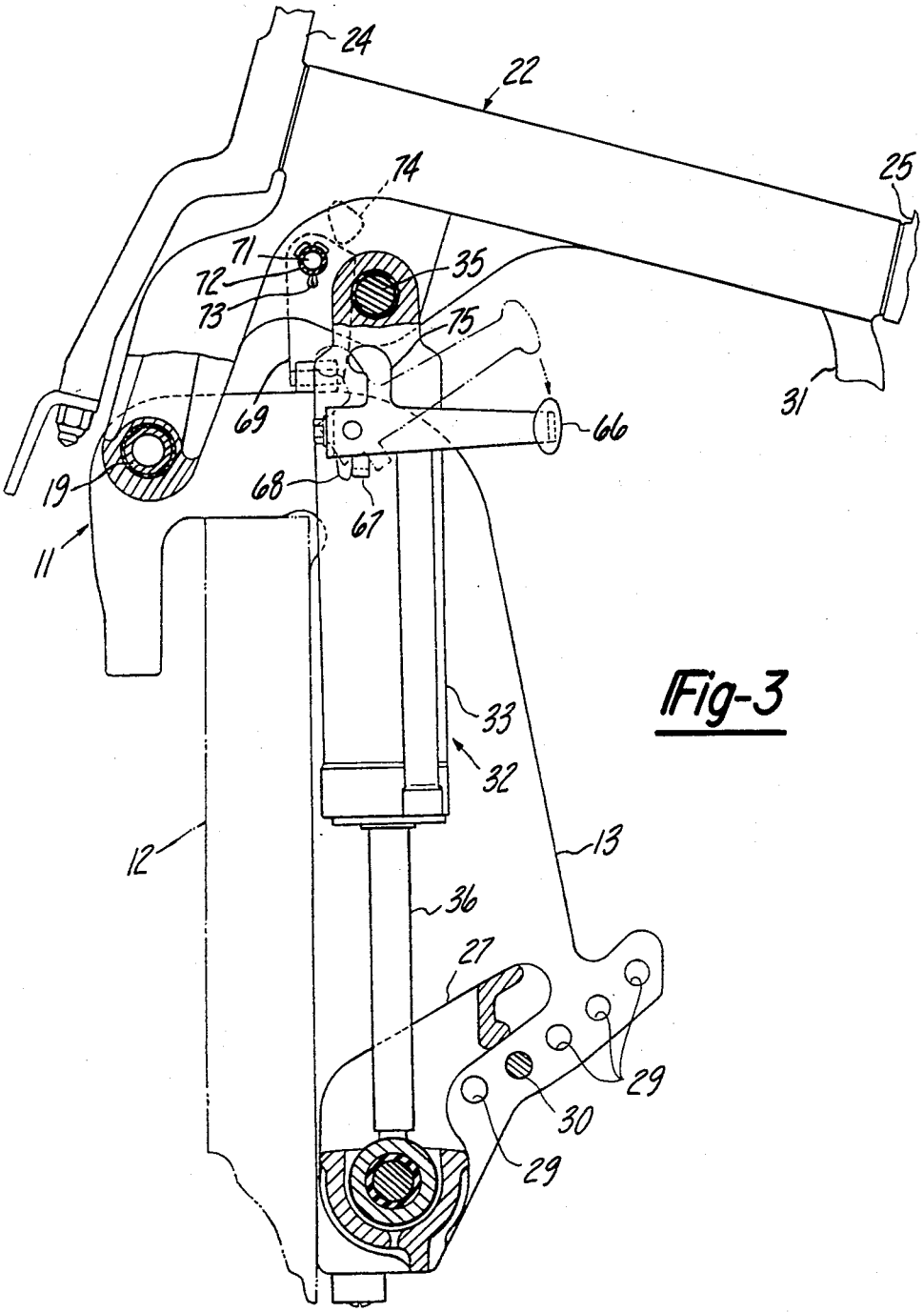
FIG. 3 is a side elevational view, in part similar to FIG. 2, showing the motor in its tilted up position.
Figure 4:
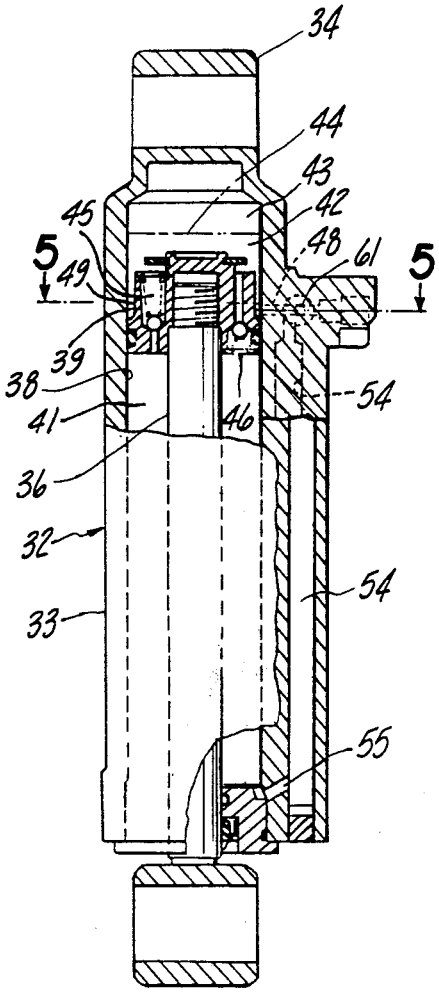
FIG. 4 is an elevational view of the hydraulic actuator associated with the motor, with portions broken away.
Figure 5:
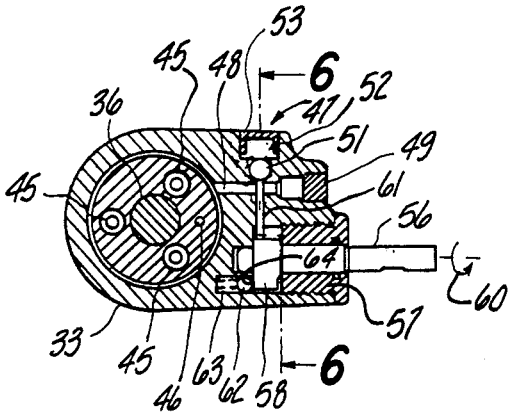
FIG. 5 is a cross-sectional view taken along the line 5—5 of FIG. 4.

As may be readily seen from FIGS. 1 through 3, the tilt lock shaft 56 is disposed in such an orientation relative to the cylinder housing 33 so that it extends parallel to the pivot pins 35 and 37 and is accessible at the side of the engine. An operating lever 66 is affixed against rotation to the tilt lock operating shaft 56 and has a projecting end 67 that is normally engaged with a lug 68 formed on the cylinder housing 33 when the handle 66 and shaft 56 are in their normal, locked position, as shown in the solid line views of FIGS. 2 and 3.

A tilt stop mechanism is provided for holding the motor and specifically the swivel bracket 22 in its tilted up position. The tilt stop mechanism comprises a pair of tilt stop levers 69 that are each affixed to a respective tilt stop shaft 71 that is journaled for pivotal movement in the swivel bracket 22. The shafts 71 are interconnected for simultaneous rotation by means of a coupling member 72 and cotter pins 73. The tilt stop levers 69 are pivotal between a released position, as shown in FIG. 2, wherein they engage a suitable stop 74 and an operative position, as shown in FIG. 3, wherein they are adapted to engage the upper side of the clamp bracket assembly 11 so as to prevent pivotal movement of the motor and swivel bracket in a clockwise direction about the pivot pin 19. As such, the motor and swivel bracket 22 will be retained clear of the water by the tilt stop mechanism including the tilt stop levers 69.

The tilt lock operating handle 66 is provided with a projecting portion 75 that is disposed in a location such that it can be contacted by one of the tilt stop levers 69 when they are rotated to their operative, locking position. As will be seen in FIG. 3, if the tilt lock operating handle 66 is positioned in its released position, as indicated by the phantom line view, the projection 75 will be disposed so that it will be engaged by one of the tilt stop levers 69 when it is rotated to its locked position. Therefore, the tilt locking mechanism including the handle 66 and shaft 56 will be automatically rotated back to the locked position when the tilt stop levers 69 are moved to their operative position.

As may be readily apparent from FIG. 3, the stop 74 in addition to limiting the movement of the tilt stop levers 69 to their released position also is disposed so that it will limit the movement of the tilt stop levers 69 to their engaged position. Thus, a single stop is effective to perform both functions.

Lubricant holes 76 extend through the clamp bracket plates 13 and 14 so that grease or other lubricant can be introduced to the area between the pivot pin 19, these plates and the swivel plate 22. The lubricant holes 76 are normally closed by means of plugs 77. By removal of the plugs 77 and use of a suitable grease fitting, grease can be introduced into this area. This is simplier than providing permanent grease nipples as was previously the practice.

Operation

FIGS. 1 and 2 show the engine in its normal operating position. In this position the tilt stop lever 69 are rotated to their released position and the tilt locking mechanism, including the operating lever 66 and operating shaft 56, are positioned in their locking position with the projection 67 in engagement with the lug 68. The check valve 52 will, therefore, function normally as a check valve and the free flow of oil from the chamber 42 to the chamber 41 as may occur when the valve element 51 is opened will be precluded.

If the boat is travelling along and strikes a submerged object such as driftwood, rocks or the like with sufficient impact, the swivel bracket 22 may tilt upwardly causing the cylinder assembly 33 to move upwardly relative to the piston assembly 39. When this occurs, oil may flow from the lower chamber 41 to the upper chamber 42 through opening of the check valves 45. The check valves 45 have their springs and orifices determined so that a certain degree of force must be encountered before the swivel unit 22 may tilt upwardly. This insures that the swivel unit 22 will not inadvertently swing upwardly during reverse operation.

When the submerged obstacle has been passed, the weight of the motor acting on the swivel bracket 22 will cause the cylinder assembly 33 to again move downwardly. When this occurs, fluid is returned from the chamber 42 to the lower chamber 41 through opening of either or both of the check valves 46 and 47.

When it is desired to tilt the motor up, the tilt lock operating lever 66 is pivoted in a counterclockwise direction as shown in FIGS. 2 and 3 from its locked position to its released position, as shown in the phantom line views in these figures. This will cause rotation of the tilt lock operating shaft 56 and cam 58 to actuate the pin 61 and unseat the ball valve element 51. The bypass passage is then opened and oil may flow freely from the lower chamber 41 to the upper chamber 42 through this bypass passage and the motor may be easily pivoted to its tilted up position, as shown in FIG. 3. Immediately prior to release of the motor, the tilt stop mechanism consisting of the levers 69 are pivoted in a counterclockwise direction about the pivot pins 71 so that the tilt stop levers 69 will be positioned to engage the upper surface of the clamping assembly plates 13 and 14. When so rotated, one of tilt stop levers 69 will engage the operating handle projection 75 and pivot it from its released position to its locked position. The motor and swivel bracket will then be supported in their tilted up position by the tilt stop levers 69.

When it is desired to again lower the motor to its normal running condition, the motor and swivel bracket 22 is pivoted slightly upwardly so as to release the load from tilt stop levers 69. The tilt stop levers 69 are then rotated to their released position as shown in FIG. 2 and the motor can be released by the operator. The weight of the motor will cause the cylinder assembly 33 to move downwardly. Rapid downward movement, however, is precluded by the check valves 46 and 47. Oil will then flow slowly from the chamber 42 to the chamber 41 through one or both of these check valves and the engine may return to its normal trim condition determined by the contact of the projection 31 with the trim lock rod 29. It will be unnecessary for the operator to again insure that the tilt locking mechanism is in its locked position since, as has been noted, the tilt lock mechanism is moved to its locked position once the engine is support on the tilt stop levers 69.

Although the invention has been described in conjunction with a specific type of hydraulic cylinder and bypass valve assembly, it is to be understood that the invention can be used with any of a variety of such assembly; for example, any of those shown in the copending application of Takashi Iwashita, entitled "Tilt Lock System For Outboard Engines" Ser. No. 326,553 filed Dec. 2, 1981. All that is necessary is that the tilt lock valve be arranged so that its locking handle will be engaged by the tilt stop mechanism when it is moved to its engaged position. Various other changes and modification may be made without departing from the spirit and scope of the invention, as defined by the appended claims.

I claim:

1. In an outboard drive unit having a first member adapted to be affixed to the hull of a boat, a drive unit supported for pivotal, tilting movement by said first member about a generally horizontally extending axis, tilt stop means movable between a released position and an operative position for retaining said drive unit in a tilted up position, tilt lock means movable between a released position and a locked position for releasably restraining said drive unit in a tilted down position, the improvement comprising means on said tilt stop means engageable with means on said tilt lock means for moving said tilt lock means from its released position to its locked position upon movement of said tilt stop means to its operative position when said drive unit is in its tilted position.

2. A tilt lever returning mechanism as set forth in claim 1 wherein the tilt lock means includes a tilt lock operating lever movable between a released position and a locked position for operating said tilt lock means, the means on said tilt stop means being engageable with means on said tilt lock lever.

3. A tilt lever returning mechanism as set forth in claim 2 wherein the means on the tilt stop means comprises an element that is directly engageable with a portion of the tilt lock operating lever.

4. A tilt lever returning mechanism as set forth in claim 1 further including hydraulic shock absorbing means interposed between the drive unit and the first member and adapted to provide hydraulic damping for movement between said drive unit and said first member, said tilt lock means comprising a bypass passage for selectively disabling said shock absorbing means and valve means in said bypass means.

5. A tilt lever returning mechanism as set forth in claim 4 wherein the tilt lock means includes a tilt lock operating lever movable between a released position and a locked position for operating said tilt lock means, the means on said tilt stop means being engageable with means on said tilt lock lever.

6. A tilt lever returning mechanism as set forth in claim 5 wherein the means on the tilt stop means comprises an element that is directly engageable with a portion of the tilt lock operating lever.

7. A tilt lever returning mechanism as set forth in claim 6 wherein the valve means comprises a check valve normally operative to permit flow at a restricted rate in one direction and preclude flow in the opposite direction and means for manually opening the check valve to permit unrestricted flow in both directions.

* * * * *